US006473999B2

(12) United States Patent
Fellouhe

(10) Patent No.: US 6,473,999 B2
(45) Date of Patent: Nov. 5, 2002

(54) SPORT BOOT INCLUDING AN INTEGRATED LACE STORING DEVICE

(75) Inventor: Catherine Fellouhe, Annecy-le-Vieux (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/210,375

(22) Filed: Dec. 14, 1998

(65) Prior Publication Data

US 2001/0025434 A1 Oct. 4, 2001

(30) Foreign Application Priority Data

Dec. 17, 1997 (FR) ..... 97 16290

(51) Int. Cl.[7] ..... A43B 23/26; A43C 11/12

(52) U.S. Cl. ..... 36/50.1; 36/54; 36/136; 24/712.1

(58) Field of Search ..... 36/54, 50.1, 136; 24/712.1, 712.2, 712.3

(56) References Cited

U.S. PATENT DOCUMENTS

| | | | | |
|---|---|---|---|---|
| 312,675 | A | * | 2/1885 | Turner |
| 647,824 | A | * | 4/1900 | Girtanner |
| 1,876,263 | A | * | 9/1932 | Pittroff |
| 2,983,011 | A | | 5/1961 | Winchester |
| 3,176,362 | A | * | 4/1965 | Tames |
| 3,845,575 | A | * | 11/1974 | Boden |
| 4,372,060 | A | * | 2/1983 | Adamik |
| 4,485,529 | A | * | 12/1984 | Blum |
| 4,630,383 | A | * | 12/1986 | Gamm |
| 4,955,150 | A | * | 9/1990 | Fagan |
| 5,165,190 | A | * | 11/1992 | Smyth |
| 5,170,573 | A | * | 12/1992 | Clinch |
| 5,293,675 | A | * | 3/1994 | Shai |
| 5,402,589 | A | * | 4/1995 | Lubrani et al. |
| 5,477,593 | A | | 12/1995 | Leick |
| 5,724,679 | A | * | 3/1998 | Hans |
| 5,778,500 | A | * | 7/1998 | Illingworth |

FOREIGN PATENT DOCUMENTS

| | | | |
|---|---|---|---|
| DE | 111303 | | 5/1899 |
| DE | 496023 | * | 3/1930 |
| DE | 8872872 | | 2/1989 |
| EP | 0629793 | | 12/1994 |

* cited by examiner

*Primary Examiner*—Ted Kavanaugh
(74) *Attorney, Agent, or Firm*—Greenblum & Bernstein, P.L.C.

(57) ABSTRACT

A boot, particularly a sport boot, having an external sole on which an upper, demarcating a central introduction zone for the foot, is mounted, and having a lacing zone constituted of a lace or cable forming two strands that connect return elements of the lacing zone together through a predetermined course, and which are linked near their free ends to an immobilizing device or a clamp, wherein it has, near the introduction zone for the foot, at the end of the lacing zone, a storing pocket capable of receiving the free ends of the lace strands extending beyond the clamp after the quarters are tightened, as well as the clamp itself.

24 Claims, 2 Drawing Sheets

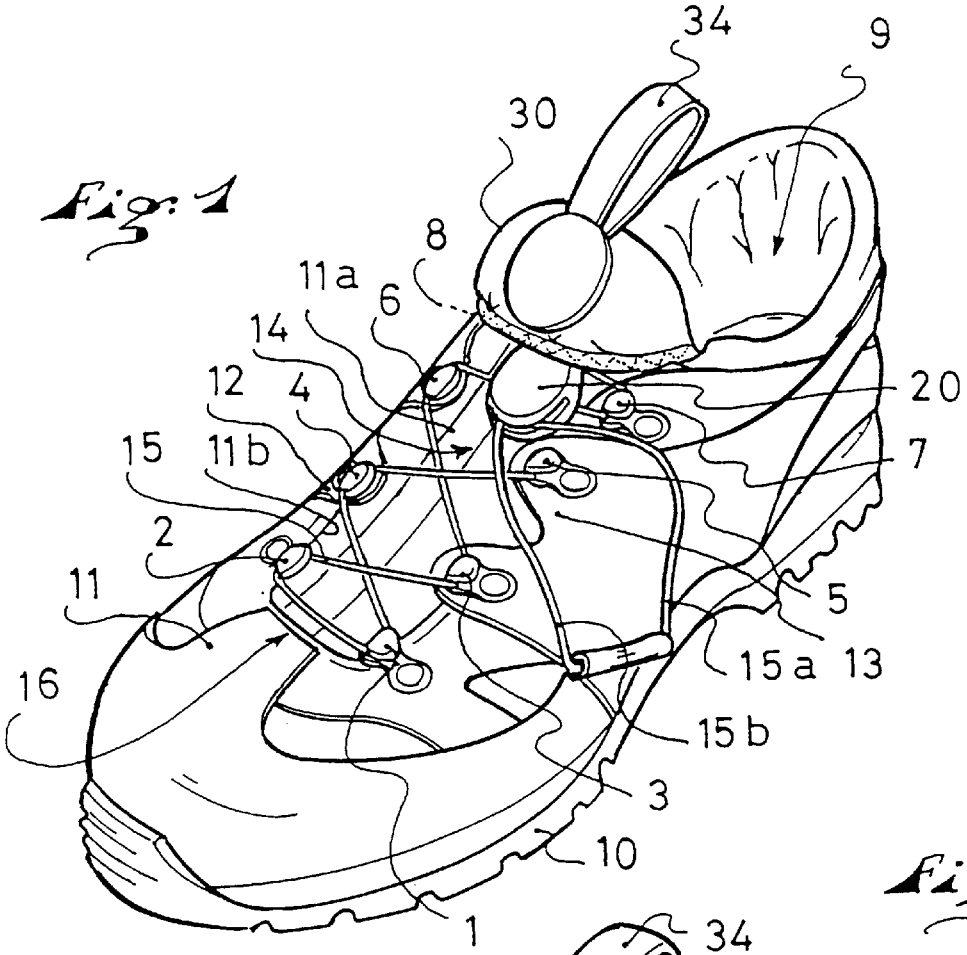
Fig. 1
Fig. 2
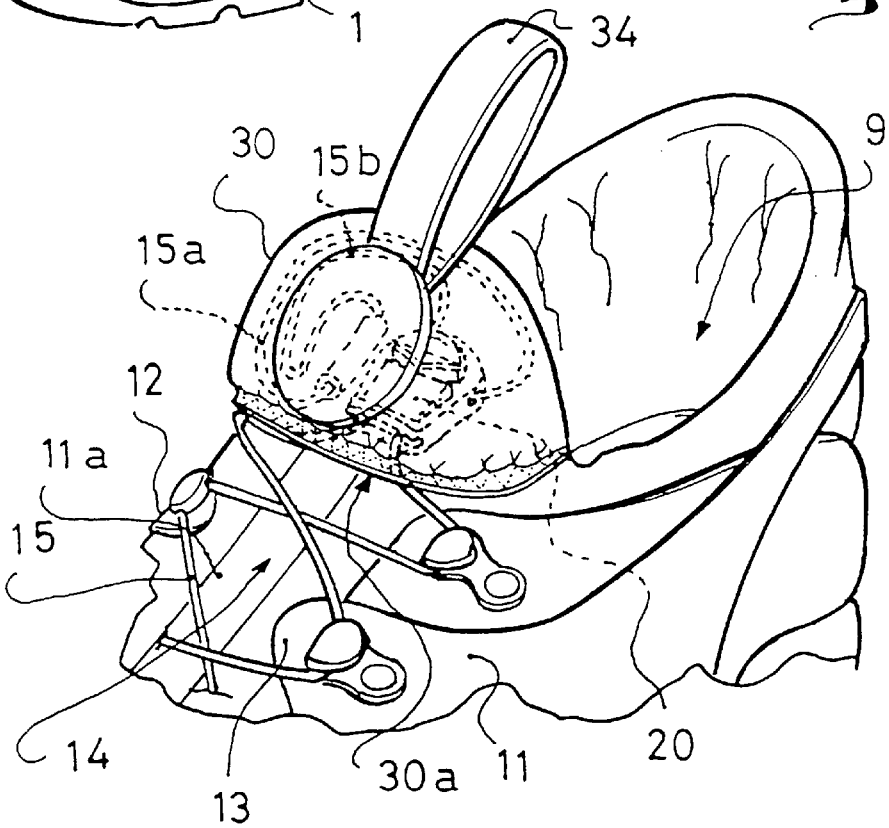

SPORT BOOT INCLUDING AN INTEGRATED LACE STORING DEVICE

BACKGROUND OF THE INVENTION

1. Field of the Invention

The present invention relates to a sport boot having, in a conventional way, an external sole on which an upper is mounted, demarcating a central introduction zone for the foot in relation to an opening made on its front upper part that is demarcated by laterally opposed quarters, on which a lace or cable forming two lacing portions and connecting the quarters by means of return elements, such as eyelets, loops, or hooks, is susceptible to act by tightening.

The invention relates to a boot of this type also having an immobilizing device or a clamp connected to the lacing portions near their free ends.

2. Description of Background and Material Information

The presence of a clamp constitutes an advantage known in itself in the sense that it allows a rapid tightening by traction on the laces and an immediate immobilizing by displacing the clamp towards a clamping position.

Such clamps are particularly interesting for racing conditions since they guarantee a constant tightening and overcome problems of ill-timed loosening that occurs with conventional knot tightening systems.

Nevertheless, if clamps bring a sure advantage to the field of sport boots, they induce, in other respects, a major drawback relating to the ends of the lacing portions, formed by the lace, that become free beyond the clamp and present a real danger in that they represent a possibility of hooking or becoming attached to something when walking or during any sport practice, if their storing is not ensured in one way or another.

Thus, clamps are known which allow storing the lace ends on the very inside of the body constituting the storing element, but this leads to designing an assembly that is relatively bulky, heavy, and not very efficient, capable of constituting a discomfort when practicing certain sports.

German Utility Patent G 88 10 872.4 calls for a device for storing lace ends or, more specifically, the loops formed by the ends when tied in a knot, constituted of a folding flap arranged in this zone and closing on a corresponding part via self-gripping means arranged on both sides and acting reciprocally.

Such a storing device has the drawback, due to the very presence of the self-gripping means, of requiring special laces that do not catch thereon.

Furthermore, the device described in the aforementioned utility patent only relates to a boot with laces that does not have a clamping device, and therefore which is not adapted to the storing of a bulkier lace clamp which cannot cooperate with the self-gripping means. In fact, the object of this storing device is to avoid the loosening of the knot, a problem which does not occur in a clamp tightening system.

SUMMARY OF THE INVENTION

An object of the present invention is to overcome the drawbacks of the aforementioned lace clamps, and especially to provide an improved system for protecting the clamp and lace ends.

To this end, it relates to a sport boot having an external sole on which an upper, demarcating a central introduction zone for the foot, is mounted, and having a lacing zone constituted of a lace or cable forming two lacing portions that connect return elements of the lacing zone together through a predetermined course, and which are attached near their free ends to an immobilizing device or clamp, wherein it has, in the vicinity of the foot introduction zone, at the end of the lacing zone, a storing pocket capable of receiving the free ends of the lacing portions, extending beyond the clamp after the quarters are tightened, as well as the clamp itself.

The present invention thus allows completely separating the functions of clamping ensured by the clamp and of "anti-hooking" storing ensured by the pocket, and therefore allows ensuring a perfect safety by completely protecting the clamping system and preventing the ill-timed hooking of the free lacing portions.

BRIEF DESCRIPTION OF DRAWINGS

The present invention also relates to the features which will appear in the following description and which should be considered separately or according to all their possible technical combinations.

This description, given by way of non-limiting example, will make it better understood how the invention can be embodied, with reference to the attached schematic drawing showing a preferred embodiment in which:

FIG. 1 shows, in perspective, a sport boot having a storing pocket according to the invention;

FIG. 2 is, on an enlarged scale, a perspective view of the zone of the boot of FIG. 1 with the g pocket, after storing the clamp and of the lace;

DETAILED DESCRIPTION OF THE INVENTION

Figure 3:
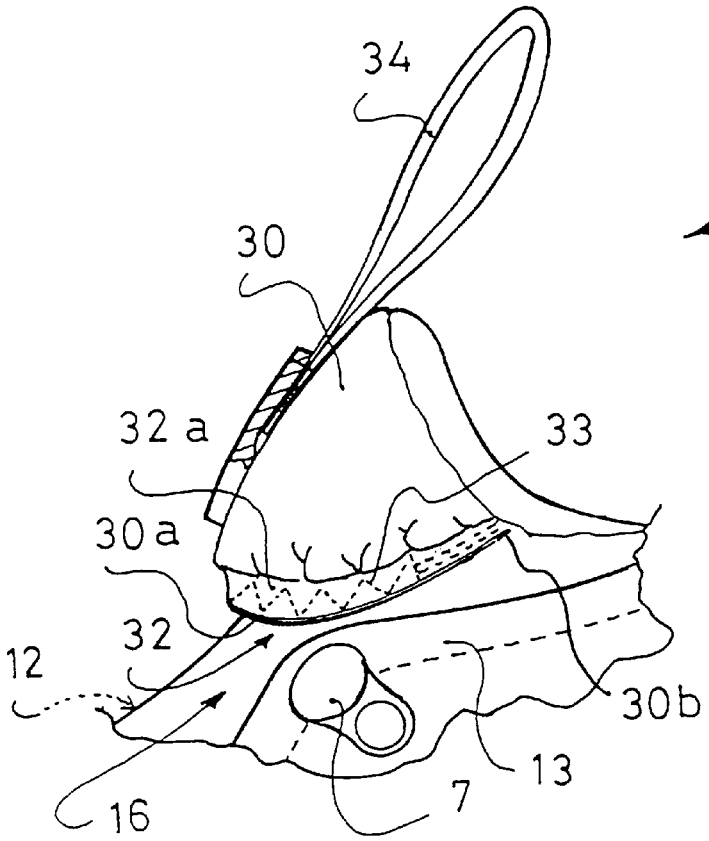
FIG. 3 is a lateral schematic view of the boot portion according to FIG. 2, when empty.
Figure 4:
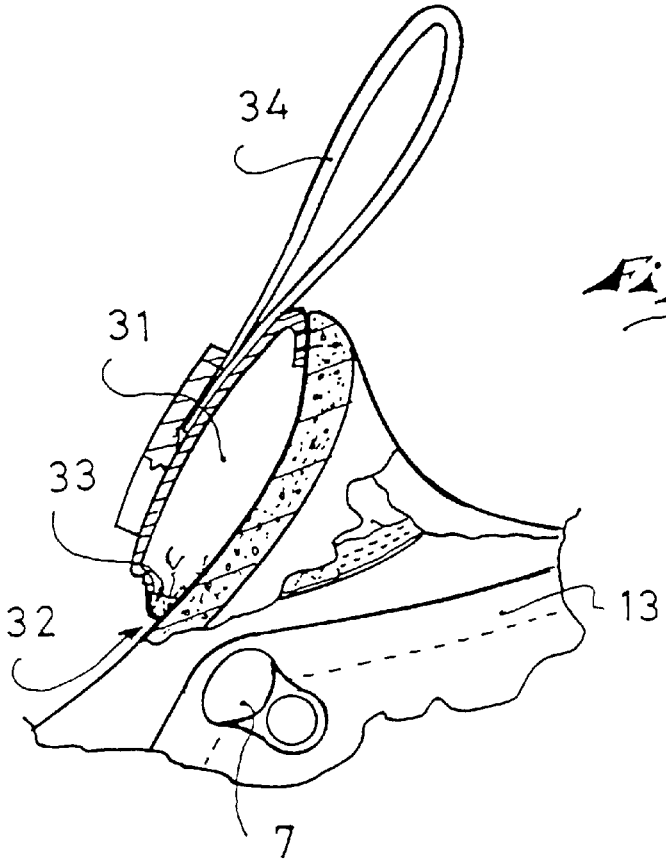
FIG. 4 is a partial longitudinal cross-sectional view of FIG. 3.

The sport boot shown in FIG. 1 has an external sole 10 on which an upper 11 is mounted, in this case a closed upper, provided at its upper end with a central introduction zone 9 for the foot, and having a medial quarter 12 and a lateral quarter 13 connected together by a tightening system 14. This tightening system 14 is constituted by a lace or cable forming two lacing portions 15*a* and 15*b* linked to a lace immobilizing device or clamp 20 and connecting together, along a predetermined course, a series of return elements, loops, eyelets or hooks 1–8 that are fixedly arranged on the respective edges 11*b* located opposite the quarters 12, 13. These generally longitudinally extending, laterally opposed edges 11*b* define a lacing zone 16 between them, such that during a tractional action on the lacing portions 15*a* and 15*b* of the lace 15, the latter tightens the quarters 12, 13 through the return elements 1–8.

Thus, the edges 11*b* of the quarters 12, 13 are brought close together and are held in a tightening position on the foot through a clamp 20.

The description and functioning of such a clamp corresponds, for example, to that which was the object of commonly owned French Patent No. 2 706 743, the disclosure of which is hereby incorporated by reference-thereto in its entirety and which, therefore, is not described further herein.

According to the invention, the boot has, near the introduction zone 9 for the foot, at the upper end of the lacing zone 16, a storing pocket 30 capable of receiving the free ends of the lacing portions 15*a*, 15*b* of the lace 15, extending beyond the clamp 20 after the quarters 12, 13 are tightened, as well as the clamp 20 itself. Inasmuch as the lacing portions 15*a*, 15*b* are shown connected together to form a loop, instead of "ends" the portions 15*a*, 15*b* of the lace can be considered simply to include free "parts", i.e., parts that are "free" in the sense that they extend beyond the clamp 20.

According to the present embodiment, the storing pocket 30 is made of a deformable flexible material attached so as to straddle the upper edges of the two quarters 12, 13 of the upper 11, at the upper end of the lacing zone 16, to cap it and demarcate therewith a closed housing 31 accessible from the exterior through an opening system 32.

Preferably, the opening system of the storing pocket 30 is arranged on a front wall which is free with respect to the foot or the boot itself.

According to a preferred embodiment shown in the figures, the opening system 32 of the storing pocket 30 is constituted by a free lower edge 30*a* of its front wall, permanently applied, or biased, against the upper 11 at the upper end of the lacing zone 16, through an elastic material 32*a* incorporated to the edge 30*a*, so as to allow, on the one hand, its lifting by a manual gripping corresponding to an opening of the pocket 30 in order to store therein the ends 15*a*, 15*b* of the lace 15 after clamping and the clamp 20 itself and, on the other hand, its return against the upper 11, occurring automatically by elastic return after release of the manual action. Thereby, the elastic material 32*a* applies an elastic pocket-closing force to move the free edge 30*a* toward the upper 11 upon release of the edge 30*a*. Further, the elastic material 32*a* and the free edge 30*a*, with which the elastic material is incorporated, can be considered to be at least partially define a means for closing the storing pocket 30.

Other closing systems are also contemplated. For example, a slide closing system, for example, could be utilized or even a lace or cord closing arranged in any area of the front wall of the pocket 30, after having made an opening therein.

Thus, the elastic material 32*a* can be constituted of an elastic incorporated in a hem made near the free edge 30*a* by a seam 33. Such an elastic can also be replaced by an elastic band sewn in the same zone.

Furthermore, according to the present embodiment, the peripheral edges of the storing pocket 30 are, except for its lower front edge 30*a*, sewn to upper end zones of the quarters 12, 13 and to adjacent zones of the central opening 9 extending from both sides of the quarters 12, 13. By means of such stitching, e.g., the storing pocket 30 is permanently formed. Also, as seen in FIG. 3, e.g., the lower front edge 30*a* of the storing pocket 30 extends forwardly from each of its ends 30*b*, where it is affixed to quarters 12, 13, respectively, or otherwise on opposite sides of the upper, to an intermediate portion at the front of the storing pocket 30. By means of such stitching, e.g., the storing pocket 30 is permanently formed.

In the case of a construction of a conventional upper, i.e., provided with a longitudinal fitting opening and with a tongue arranged beneath the opening, the storing pocket 30 can be arranged at the upper end of the tongue of the boot. In such a construction of an open upper, the tightening system 14 also serves as a closing system for the upper. In all of the cases, the elastic application of the free lower edge 30*a* of the pocket against the upper 11 is particularly interesting since it guarantees holding the lace ends and clamp in position inside the pocket.

Such a pocket therefore not only guarantees safety by preventing any exiting of the clamp and lace ends, but also protects the clamp mechanism from exterior aggressions.

According to another feature of the invention, the opening of the storing pocket 30, which occurs by lifting its elastic lower front edge 30*a*, is done by means of a gripping element 34, affixed to its free front wall.

As for this gripping element 34, it can be a flexible loop in the shape of a strap, as shown in the figures, but also any type of gripping means.

The instant application is based upon French Patent Application No. 97 16290, filed Dec. 17, 1997, the disclosure of which is hereby expressly incorporated by reference thereto in its entirety, and the priority of which is hereby claimed under 35 USC 119.

What is claimed is:

1. A sport boot comprising:

an external sole on which an upper is disposed, the upper demarcating an introduction zone for a foot;

a lacing zone comprising return elements and at least two lacing portions that connect the return elements of the lacing zone together through a predetermined course, the lacing portions having respective free parts;

a permanently formed storing pocket disposed adjacent the foot introduction zone and at an upper end of the lacing zone, the storing pocket comprising a flexible deformable material and having a free edge positioned on the upper, the free edge at least partially defining a forwardly and downwardly facing opening of the storing pocket;

an elastic material positioned along the free edge of the storing pocket and elastically biasing the free edge toward the upper to close the storing pocket;

an immobilizing device linking the two lacing portions, the immobilizing device being positioned, relative to the storing pocket, to be moved into and removed from the storing pocket;

wherein the storing pocket has a size and shape to receive and contain the immobilizing device and the free parts of the two lacing portions.

2. A sport boot according to claim 1, wherein the storing pocket further comprises at least one peripheral edge which is sewn to the upper.

3. The sport boot of claim 1, further comprising a gripping element affixed to and extending away from the moveable front wall.

4. The sport boot of claim 1, wherein the storing pocket further comprises at least one peripheral edge which is sewn to an upper end of a tongue.

5. A sport boot according to claim 1, wherein the upper further comprises a medial quarter and a lateral quarter, wherein the storing pocket comprises peripheral edges, the free edge being one of the peripheral edges, and wherein all of the peripheral edges except for the free edge are sewn to upper zones of the medial and lateral quarters.

6. A sport boot according to claim 1, wherein the free edge of the storing pocket has opposite ends fixed to opposite sides of the upper and wherein the free edge extends forwardly from the opposite ends to an intermediate portion at a front of the storing pocket.

7. A sport boot comprising:

an external sole and an upper disposed on said external sole, said upper including an introduction zone for a foot, said upper further comprising a medial quarter and a lateral quarter;

a plurality of return elements positioned along said medial quarter and a plurality of return elements positioned along said lateral quarter;

a lacing zone disposed on said upper, said lacing zone extending from a forward lower end to a rearward upper end;

a storing pocket comprising a front wall extending to a free edge along a lowermost extent of said front wall, said free edge allowing an opening of said storing pocket upon manual gripping and lifting of said free edge;

a closing system applying a pocket-closing force to move said free edge upon being released from said manual gripping, said closing system comprising an elastic material affixed at said free edge of said storing pocket, said pocket-closing force of said closing system comprising an elastic force;

a tightening system connecting said pluralities of return elements of said quarters of said upper from said forward lower end of said lacing zone rearward toward said rearward upper end of said lacing zone, said tightening system comprising a clamp and two lacing portions, each of said two lacing portions extending into said clamp and each of said two lacing portions having free parts extending out of said clamp, said clamp immobilizing said two lacing portions with respect to each other;

said storing pocket having a size and shape to receive and store said clamp and said free parts of said two lacing portions.

8. A sport boot according to claim 7, wherein:

said storing pocket further comprises at least one peripheral edge which is stitched to said upper.

9. A sport boot according to claim 7, further comprising:

a tongue extending rearwardly to said rearward upper end of said lacing zone;

said storing pocket further comprises at least one peripheral edge which is stitched to an upper end of said tongue.

10. A sport boot according to claim 7, wherein:

said front wall extends forwardly to said free edge;

a gripping element is affixed to and extends from said front wall.

11. A sport boot according to claim 7, wherein:

said storing pocket further comprises at least one peripheral edge which is stitched to said upper.

12. A sport boot according to claim 7, further comprising:

a tongue extending rearwardly to said rearward upper end of said lacing zone;

said storing pocket further comprises at least one peripheral edge which is stitched to an upper end of said tongue.

13. A sport boot according to claim 7, wherein:

said opening of said storing pocket comprises a downwardly and forwardly facing opening.

14. A sport boot according to claim 7, wherein said storing pocket comprises peripheral edges, said free edge being one of said peripheral edges, and wherein all of said peripheral edges except for said free edge are sewn to upper zones of said medial and lateral quarters.

15. A sport boot according to claim 7, wherein said free edge of said storing pocket has opposite ends fixed to opposite sides of said upper and wherein said free edge extends forwardly from said opposite ends to an intermediate portion at a front of said storing pocket.

16. A sport boot comprising:

an external sole and an upper disposed on said external sole, said upper including an introduction zone for a foot, said upper further including a medial quarter and a lateral quarter;

a plurality of return elements positioned along said medial quarter and a plurality of return elements positioned along said lateral quarter;

a lacing zone disposed on said upper, said lacing zone extending from a forward lower end to a rearward upper end;

a tightening system connecting said pluralities of return elements of said quarters from said forward lower end of said lacing zone rearward toward said rearward upper end of said lacing zone, said tightening system comprising a clamp and two lacing portions, each of said two lacing portions extending into said clamp and each of said two lacing portions having free parts extending out of said clamp, said clamp immobilizing said two lacing portions with respect to each other;

a storing pocket having a forwardly facing opening, said opening of said pocket being bordered by an anti-hooking interior surface, said anti-hooking interior surface extending to a free edge, said free edge opening said storing pocket upon manual gripping and lifting of said free edge, said storing pocket having a size and shape to receive and store said clamp and said free parts of said two lacing portions;

means for closing said storing pocket with said clamp and said free parts of said two lacing portions stored therein.

17. A sport boot comprising:

an external sole on which an upper is disposed, the upper comprising laterally disposed quarters, demarcating an introduction zone for a foot, and a plurality of return elements extending rearwardly along the quarters defining a lacing zone disposed on the upper;

a tightening system including:

a pair of lacing portions interconnecting the return elements to tighten the upper on a foot of a user upon application of a traction force to the lacing portions; and a lacing immobilizing device positioned rearward of the return elements, the lacing portions including free parts extending through the immobilizing device and extending from the immobilizing device;

a permanently formed storing pocket comprising a deformable flexible material and a moveable front wall, the moveable front wall comprising a free lower edge thereby establishing an opening at a lowermost extent of said moveable front wall;

an elastic material biasing the free lower edge of the moveable front wall toward a boot surface to maintain the storing pocket closed;

wherein the storing pocket is defined by a substantially closed housing which is attached in a straddling position at an upper end of the lacing zone, the housing being substantially disposed at the upper end of the lacing zone, the storing pocket having a size and shape to receive the immobilizing device and the free parts of the lacing portions through the opening of the storing pocket and to store the immobilizing device and the free parts of the lacing portions in the storing pocket.

18. A sport boot according to claim 17, wherein:

said opening of said storing pocket comprises a forwardly and downwardly facing opening.

19. A sport boot according to claim 17, wherein the storing pocket comprises peripheral edges, the free edge being one of the peripheral edges, and wherein all of the peripheral edges except for the free edge are sewn to upper zones of the laterally disposed quarters of the upper.

20. A sport boot according to claim 17, wherein the free edge of the storing pocket has opposite ends fixed to opposite sides of the upper and wherein the free edge extends forwardly from the opposite ends to an intermediate portion at a front of the storing pocket.

21. A sport boot comprising:

an external sole and an upper disposed on said external sole, said upper including an introduction zone for a foot, said upper further including a medial quarter and a lateral quarter;

a plurality of return elements positioned along said medial quarter and a plurality of return elements positioned along said lateral quarter;

a lacing zone disposed on said upper, said lacing zone extending from a forward lower end to a rearward upper end;

a tightening system connecting said pluralities of return elements of said quarters from said forward lower end of said lacing zone rearward toward said rearward upper end of said lacing zone, said tightening system comprising a clamp and two lacing portions, each of said two lacing portions extending into said clamp and each of said two lacing portions having free parts extending out of said clamp, said clamp immobilizing said two lacing portions with respect to each other;

a storing pocket having a size and shape to receive and store said clamp and said free parts of said two lacing portions, said storing pocket comprising an opening system, said opening system comprising a free edge bordering an opening at a lower end of said storing pocket, and an elastic material located at said free edge closing said storing pocket, said free edge allowing opening of said storing pocket upon manual gripping and lifting of said free edge against an elastic force of said elastic material, and automatic closing of said storing pocket upon release of said manual gripping of said free edge with said clamp and said free parts of said two lacing portions stored in said storing pocket.

22. A sport boot according to claim 21, wherein said storing pocket comprises peripheral edges, said free edge being one of said peripheral edges, and wherein all of said peripheral edges except for said free edge are sewn to upper zones of said medial and lateral quarters.

23. A sport boot according to claim 21, wherein said free edge of said storing pocket has opposite ends fixed to opposite sides of said upper and wherein said free edge extends forwardly from said opposite ends to an intermediate portion at a front of said storing pocket.

24. A sport boot according to claim 21, wherein:

said opening of said storing pocket comprises a forwardly and downwardly facing opening.

* * * * *